United States Patent [19]

Klammers

[11] 4,413,171

[45] Nov. 1, 1983

[54] ELECTRIC COOKING OVEN FOR DOMESTIC USE

[75] Inventor: Gerard Klammers, Thionville-Garche, France

[73] Assignee: Establissements Eugene Scholtes, Lagrange-Thionville, France

[21] Appl. No.: 328,643

[22] Filed: Dec. 8, 1981

Related U.S. Application Data

[63] Continuation-in-part of Ser. No. 218,747, Dec. 22, 1980, abandoned.

[30] Foreign Application Priority Data

Dec. 27, 1979 [FR] France ..... 79 31753

[51] Int. Cl.[3] ..... F27D 11/02

[52] U.S. Cl. ..... 219/400; 126/21 A; 219/398

[58] Field of Search ..... 219/398, 396, 400, 413, 219/393; 126/21 A; 99/447

[56] References Cited

U.S. PATENT DOCUMENTS 3,587,555 6/1971 Cerola ..... 219/400 X 4,071,739 1/1978 Jeun et al. ..... 219/400

FOREIGN PATENT DOCUMENTS 2334916 12/1975 France ..... 219/400

*Primary Examiner*—Volodymyr Y. Mayewsky

*Attorney, Agent, or Firm*—Young & Thompson

[57] ABSTRACT

This electric cooking oven for domestic use incorporates an electric circuit controlling the pyrolytic cleaning operation and comprising a pivoted blade-shaped shutter connected to a first control thermostat and to the cooling turbine connected in turn to a second thermostat so adjusted as to close at a predetermined critical temperature beyond which the turbine must be protected against overheating by ventilation, the second thermostat when open being coupled in turn to a resistance adapted to provide the heat necessary for performing the pyrolytic operation, so that the turbine is started automatically by the closing of the second thermostat at the critical temperature to cause the shutter to pivot to a position in which the shutter maintains the supply of electric power for energizing the turbine when the second thermostat opens, that is, when the oven temperature has dropped to a value lower than the predetermined critical temperature.

4 Claims, 11 Drawing Figures

P
V
62
61
b
a
57
4
55
0
300°
63
50a
d
c
58
59
400°
56
0
23
7

P
V
62
61
b
a
57
4
55
0
300°
63
50
d
c
58
59
460°
56
0
23
7

ELECTRIC COOKING OVEN FOR DOMESTIC USE

This application is a continuation-in-part of my copending application Ser. No. 218,747, filed Dec. 22, 1980, and now abandoned.

BACKGROUND OF THE INVENTION

This invention is directed to provide various improvements in the electric cooking oven for domestic use disclosed in the French Patent Appln. No. 75 37589 published under the No. 2 334 916.

More particularly, this invention relates to the specific form of embodiment of the cooking oven concerned in which a pyrolytic system is provided for cleaning the oven inner walls. In this form of embodiment, the turbine housing is provided with a manually operated shutter adapted to close the air suction apertures and thus discontinue the forced-air convection inside the oven during the cleaning step while keeping the turbine in operation.

Thus, a highly detrimental overheating of the turbine sucking the air contained in the oven enclosure and then brought to a high temperature is safely avoided.

However, tests carried out with domestic ovens of this type proved that even if no turbine protection shutter effective during the pyrolysis were provided, and if the turbine remains inoperative, there is no serious risk of overheating up to a temperature of about 460° C. In fact, it is essential to protect the turbine only above this temperature level.

SUMMARY OF THE INVENTION

It is therefore the primary object of the present invention to efficiently protect the turbine above this maximum temperature (460° C.) by dispensing completely with the shutter provided in the above-mentioned patent application. Further and complementary objects of the present invention consist in:

maintaining the turbine motor at a reasonable temperature level throughout the pyrolytic process, avoiding any overpressure within the cooking enclosure or space, preventing any saturation of the grill catalyst, maintaining a carbon monoxide to carbon dioxide gas ratio at a value consistent with official standards.

The electric cooking oven according to the present invention comprises a cooking enclosure or chamber in which air heated by at least one electric resistance and blown by a centrifugal turbine mounted in a compartment formed in one of the enclosure walls is subjected to a forced convection, said turbine being surrounded by a perforated sleeve in close contact with the heating resistance so that it can be brought thereby to a red-hot condition.

According to the instant invention, the electric circuit means controlling the pyrolytic cleaning operation comprises a pivotally mounted shutter operatively connected on the one hand to a first control thermostat and on the other hand to the turbine connected in turn to a second thermostat so adjusted as to close at the predetermined critical temperature beyond which the turbine must be protected against overheating by a suitable ventilation, said second thermostat being coupled in turn, when open, to a resistance adapted to carry out the pyrolytic process, whereby the turbine will be started automatically by the closing of the second thermostat at said predetermined critical temperature, thus causing the shutter to pivot to a position in which said shutter maintains the supply of electric current for energizing the turbine when said second thermostat opens, i.e. when the oven temperature has dropped below the aforesaid predetermined critical temperature.

It is thus clear that the electric circuit is so arranged that when the predetermined critical temperature for the pyrolysis is attained, the second thermostat closes at said predetermined critical temperature, thus discontinuing the supply of current to the pyrolytic resistance. As a consequence of the closing of this second thermostat the turbine is energized and its rotation causes air to be blown and the shutter to pivot to its operative position.

As long as the second thermostat remains closed, the turbine is supplied with energizing current from both the second thermostat and the shutter. When the temperature drops below the aforesaid predetermined critical value, the second thermostat opens and restores the energization of the pyrolytic resistance means. Thus, the temperature rises again within the oven and when it is restored to the critical value the second thermostat opens and restores the energization of the pyrolytic resistance. Then, the temperature rises within the oven and therefore when the critical temperature is reached again, the second thermostat is closed again, thus discontinuing the supply of current to the pyrolytic resistance. Consequently, throughout the duration of the pyrolysis, the second thermostat is caused to "hunt" periodically between its position supplying electric current to the heating resistance and its closed position in which the resistance is cut off. However, also during the entire pyrolysis process the shutter remains in the position corresponding to the self-energization of the turbine so that air is blown by this turbine throughout the pyrolysis.

In actual practice, the maximum pyrolysis temperature is kept in the range of 460° to 500° C. The turbine motor is advantageously provided with a second turbine and therefore it is clear that this second turbine will efficiently protect by its ventilation the complete power turbine unit throughout the pyrolytic cleaning operation.

Other features and advantages of this invention will appear as the following description proceeds with reference to the accompanying drawings illustrating diagrammatically a typical and exemplary form of embodiment of the electric oven for domestic use according to the present invention.

THE DRAWINGS

DESCRIPTION OF THE PREFERRED EMBODIMENTS

Figure 2:
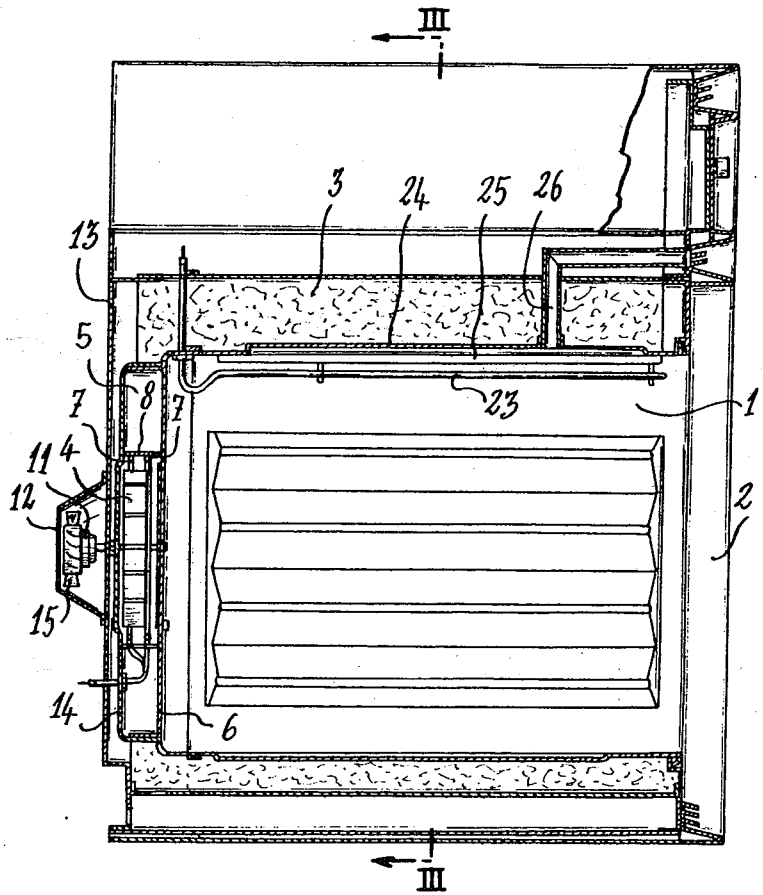
Fig. 2 PRIOR ART
FIG. 2 is a longitudinal section taken along the line II—II of FIG. 1.
Figure 1:
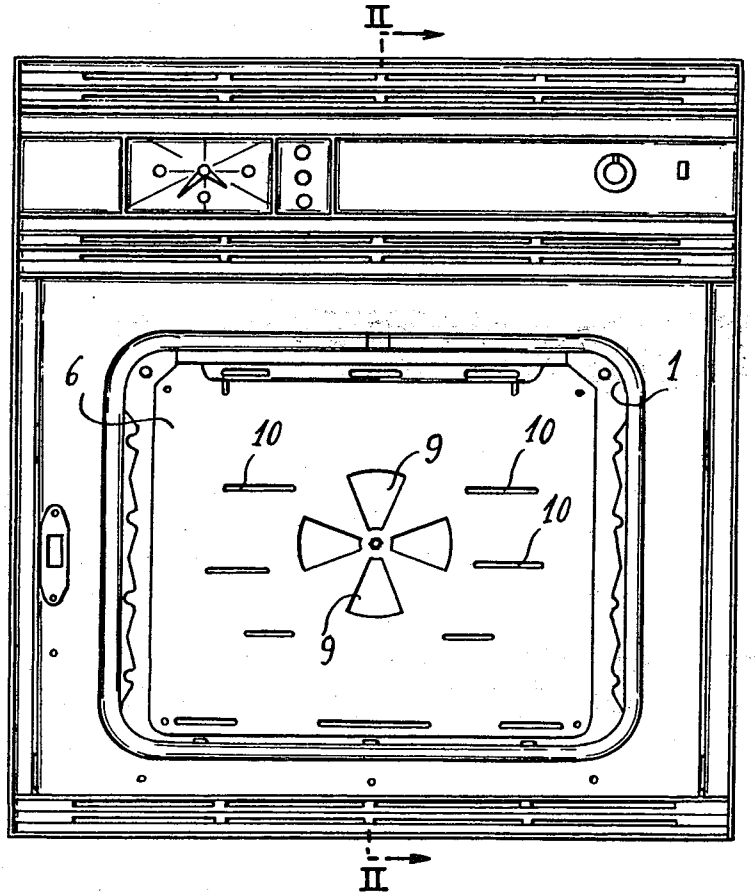
Fig. 1 PRIOR ART
FIG. 1 is a front elevational view of an oven constructed according to the teachings of the above-identified French application, the oven door being omitted for the sake of clarity.

The cooking oven for domestic use illustrated in FIGS. 1 to 4 of the drawings and corresponding to that of the above identified French application comprises a cooking enclosure or chamber 1 closed by a door 2. The walls of this enclosure are heat-insulated by a suitable lagging 3 adapted to appreciably save both time and power when pre-heating this oven.

The cooking oven incorporates a centrifugal turbine 4 mounted in a compartment 5 disposed behind the back wall 6 of the cooking enclosure. This turbine is surrounded by one or a plurality of electric heating resistances 7 of substantially annular or helical configuration. These resistances 7 are surrounded in turn by a perforated stainless-steel sheathing 8 consisting for example of stainless steel wire gauze or like shielding harness. This sheathing contacts directly the resistance or resistances 7 so as to be heated red-hot when the resistances are energized.

Formed in the central area of the back wall 6 of the cooking enclosure are several apertures 9 in the form of circular sectors through which the air can be sucked by the turbine 4. Other slit-like apertures 10 are formed in the surrounding portions of the back wall 6 to permit the passage of any air forced by the turbine into the oven enclosure. With this arrangement it is thus possible to produce a forced hot air convection in this enclosure.

The turbine 4 is driven by an electric motor 11 disposed in the rear portion of the oven housing and secured to a flanged bracket or like support 12 constituting an insert secured to the rear wall 13 of this housing which extends behind the back wall 14 of the compartment 5 containing said turbine 4. The outer case of this motor is advantageously provided with cooling fins 15 constituting a second turbine. The output shaft 16 of motor 11, to which the turbine rotor 4 is secured, is rotatably mounted in a bearing provided in an aperture of rear wall 13. This bearing comprises a graphite ring 17 fitted in a socket 18 formed with a retaining flange 19 and also with inner and outer screw-threads engaged by an inner nut 20 for tightening or clamping the graphite ring 17 in position and by a fastening outer nut 21, respectively. The edges of the apertures formed in the rear wall 13 and back wall 14 of compartment 5 are tightly clamped between the flange 19 and fastening nut 21, with the interposition of a ring seal 22 therebetween (see FIG. 4). The function of the graphite ring 17 inserted in the bearing of shaft 16 is not only to lubricate this bearing but also to prevent any undesired ingress of air into said compartment 5.

The power supply circuit of the turbine motor 11 is controlled by a thermostat responsive to the temperature prevailing within the oven. When the oven is put into service, this motor is energized together with the heating resistance or resistances for producing the desired hot air convection within the oven. In fact, air is drawn by the turbine through the central apertures 9 of the oven back wall 6. Then, this air is forced to the outer periphery of the turbine so as to flow around the resistances 7 and also through the perforated stainless-steel sheathing 8 before returning to the oven through the surrounding slits 10.

When the oven is used for cooking meat or certain foods which during the cooking thereof release smoke and/or fatty vapors, these are destroyed during the passage of the hot air stream over resistances and the perforated stainless-steel sheathing 8 also heated to a red-hot condition by said resistances. As a consequence thereof, the hot air is purified and the air stream returned to the oven is substantially free of fatty smoke and vapors. Under these conditions, the oven according to the present invention can operate at cooking temperatures definitely higher than the limit temperatures normally contemplated for air convection ovens. In fact, with the arrangement of the present invention the oven can be operated at temperatures of the order of 250° C., i.e. at the same temperature as that contemplated for conventional ovens operating by natural convection.

However, since the turbine motor is responsive to the thermostat controlling the inner temperature of the oven, when this temperature exceeds the predetermined or desired value this thermostat will stop the motor and at the same time discontinue the energization of the heating resistance or resistances. Thus, any useless and/or detrimental stirring of fatty vapors is safely avoided as long as the resistance or resistances are de-energized and therefore, together with sheathing 8, kept at a temperature too low to destroy said vapors. During this time period, only a hot air circulation by natural convection takes place. Besides, the oven operates during approximately the two-thirds of its service time under natural convection conditions and only one-third of this time under forced convection conditions.

The turbine motor control circuit further comprises a reversing switch so that the control of the turbine motor through the adjustment thermostat can be eliminated and the turbine can thus operate continuously during the oven operation. With this arrangement, the oven can be operated under continuous forced convection conditions for cooking certain foods likely to release or develop smoke or fatty vapors, for example when making cakes. In this case, cooking by forced air convection permits of making simultaneously several kinds of identical cakes during the same time period.

As in conventional ovens, the oven of the present invention comprises an electric grill resistance 23 of the so-called brisk-fire type, disposed against the ceiling 24 of the cooking enclosure. With this type of resistance it is possible to cook food like meat and fish by using infrared radiation in lieu of hot air convection as in now commercially available air-circulation ovens. It is wellknown that grilling foods with infrared radiation is considerably more satisfactory.

However, since this cooking method requires imperatively that the oven door 2 must remain open or at least half-open, it is useless in this case to operate the turbine 4 and the heating resistance 7 associated therewith.

Therefore, in order to eliminate the smoke released by the cooking process, the oven of the present invention is equipped with a grill resistance device of the type disclosed in the French Pat. No. 75 36944 entitled "Electric oven or grill".

In fact, a stainless steel box structure 25 comprising a series of narrow slits in front of the various sections of the grill resistance 23 is interposed between said sections and the ceiling 24 of the cooking enclosure, said ceiling comprising an aperture connected to a hot-air exhaust pipe 26. As already described in the above-mentioned patent, this device is adapted to destroy any smoke carried along by the hot air stream and released by the food grilled by the infrared radiation emitted by the grill resistance 23.

Of course, the oven of this invention may also comprise means for driving either a single rotary spit or a plurality of parallel spits.

Figure 5:
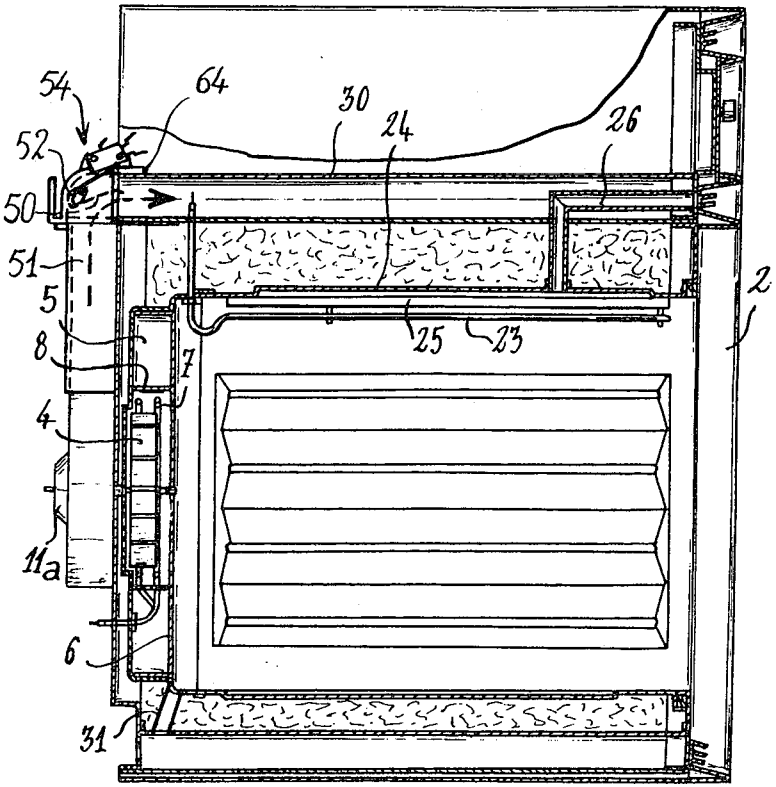
FIG. 5 is a longitudinal section similar to FIG. 2 but showing an embodiment of the oven according to the present invention.
Figure 3:
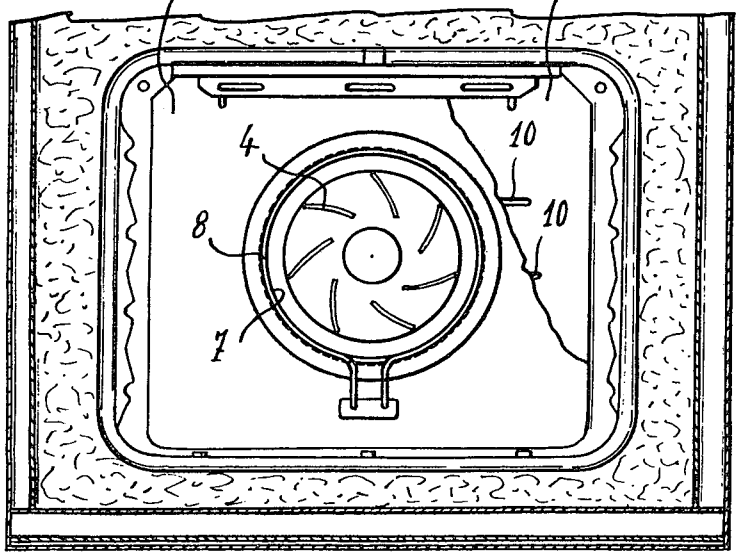
Fig. 3 PRIOR ART
FIG. 3 is a fragmentary section taken along the line III—III of FIG. 2, the major part of the back wall of the cooking enclosure, which incorporates the turbine structure, being broken away for the sake of clarity.
Figure 4:
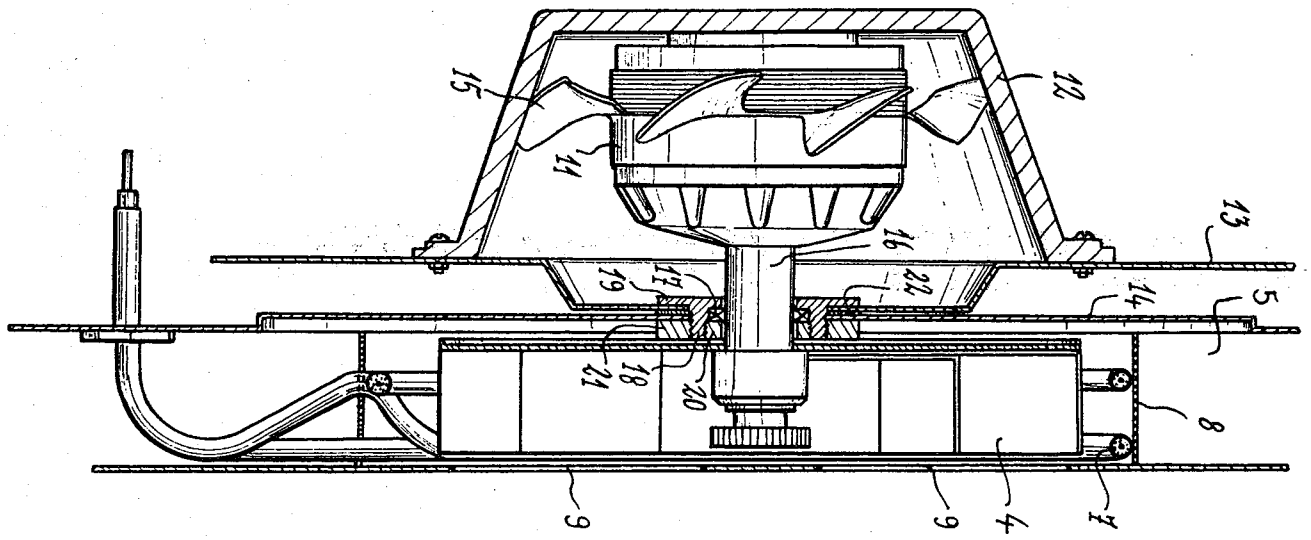
FIG. 4 PRIOR ART
FIG. 4 is a fragmentary section and elevational view showing on a larger scale the turbine incorporated in the oven of the French application, with its drive motor.

An improved form of embodiment according to the present invention is illustrated in FIG. 5, wherein means for cleaning the walls of the cooking enclosure by pyrolysis are provided, which are adapted to destroy the deposits accumulating on or adhering to said walls. For this purpose, the heat necessary for performing this cleaning operation is generated by the grill resistance 23 of the corresponding oven, the oven door being locked in its closed position during this operation and responsive to safety devices of the type usually provided in ovens equipped with such cleaning means.

The turbine 4 is completed by a second turbine 15 mounted on the same shaft 16 according to a known construction described and illustrated in the above-mentioned French Pat. No. 2,334,916.

Figure 8:
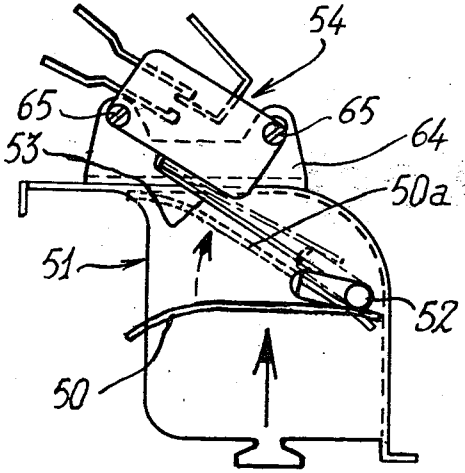
FIG. 8 is a side elevational view showing on a larger scale the device for operating the pivoting shutter disposed in the upper portion of the chimney overlying the turbine, and this shutter proper.
Figure 11:
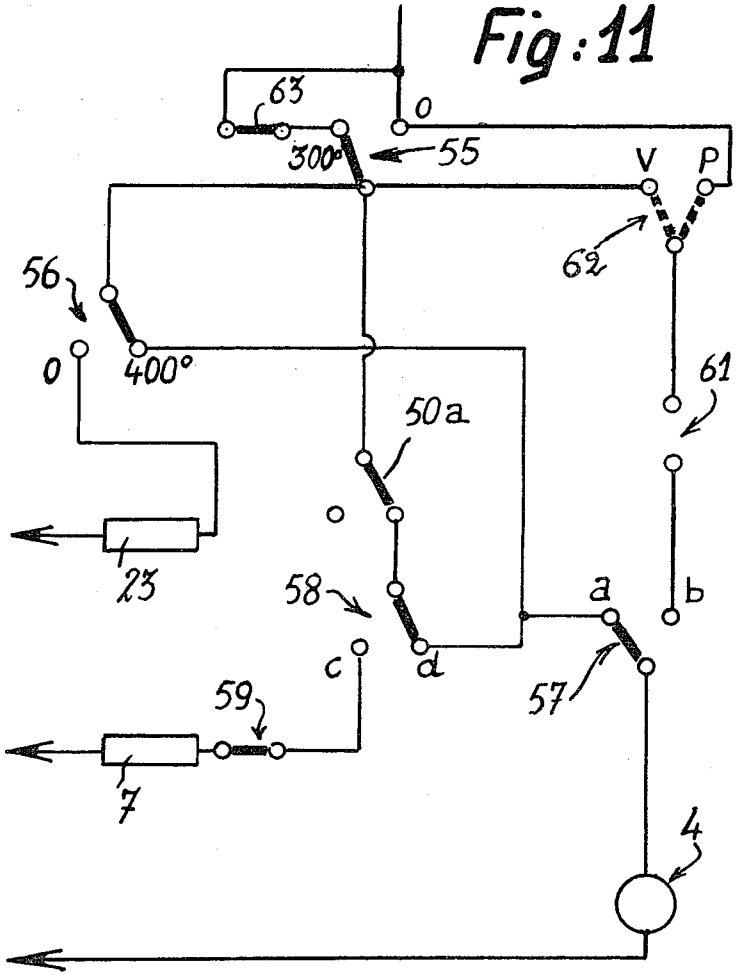
FIG. 11 illustrates the condition of the electric circuit of FIG. 1 when the critical temperature, beyond which the turbine protection must take place, is attained.
Figure 10:
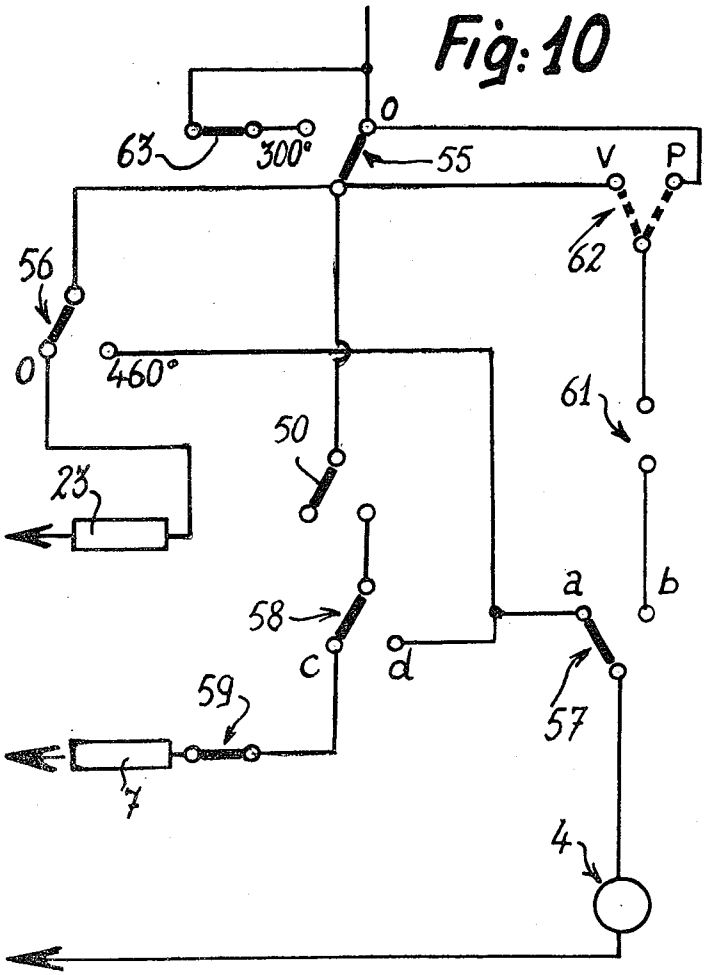
FIG. 10 illustrates a typical form of embodiment of the electric circuit means of the cooking oven according to this invention, before starting the pyrolysis operation.

The electric circuit controlling the pyrolytic cleaning operation is shown in detail in FIGS. 10 and 11, and comprises a hinged shutter 50 (FIG. 8) mounted on the upper portion of chimney 51 disposed behind compartment 5, above the turbine 4. This shutter 50 consists of a metal blade adapted to pivot from an inoperative position shown in full lines to a position in which electric current is supplied to turbine 4, as shown in dotted lines at 50*a*. This shutter 50 is mounted on a pivot shaft 52 enabling the shutter 50 to assume its lower position simply by gravity.

This shutter 50 may on the other hand pivot upwards under the pressure of the air stream blown by the turbine 4 when the latter is started, and it its raised position 50*a* the shaft 52 causes the control blade 53 of a micro-switch 54 to pivot. This blade 53 is adapted through suitable means (not shown) to close the electric contact inside said micro-switch 54.

The shutter 50 is coupled on the one hand to a first control thermostat 55 and on the other hand to the turbine 4 connected to a second thermostat 56 so adjusted or preset as to close at the critical temperature beyond which the turbine 4 must be protected against overheating by a proper ventilation. In actual practice, this limit temperature is about 460° C. Thus, the second thermostat 56 may be held in an open position in which it engages a first contact stud O to energize the grill resistance 23, and a second contact stud denoted 460° C., engaged by thermostat 56 when the temperature of 460° C. is attained in the oven. In this position 460°, the thermostat 56 closes the electric supply circuit feeding turbine 4 via a switch 57 connected to contact stud 'a'.

The first thermostat 55 is set to close at a temperature of about 300° C.; when open, this first thermostat engages contact stud O, and when closed it engages contact stud 300°.

Disposed between the shutter 50 on the one hand and the switch 57 and turbine 4 on the other hand is a third three-stage thermostat 58 set to close at a temperature lower than the predetermined critical temperature for starting the turbine 4, for example 330° C. When the thermostat 58 engages contact stud c, it interconnects the cooking resistance 7 and shutter 50. When the oven temperature has risen to 330° C. the thermostat 58 closes back to contact stud d, and interconnects on the one hand shutter 50 and first cooking thermostat 55, and on the other hand turbine 4 and switch 57.

The electric circuit comprises a second switch 59 disposed between resistance 7 and thermostat 58, and also between a programmer 61 and a pastry/meat inverter 62. This inverter 62 may be set at will either to position V for cooking meat or to another position P for cooking pastry. Finally, the circuit comprises a third switch 63 disposed between the supply mains and the thermostat 55.

Figure 7:
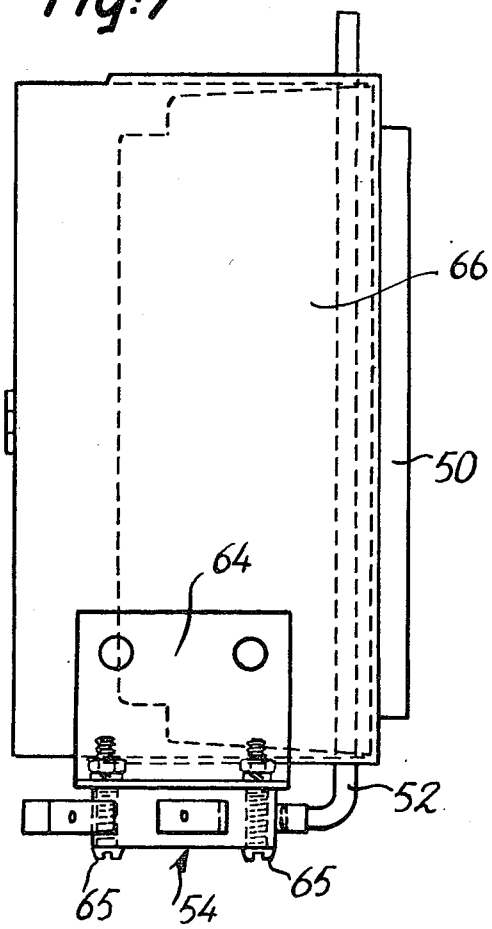
FIG. 7 is a plan view from above showing on a larger scale the upper portion of the chimney overlying the turbine and of the safety shutter actuating device of the present invention.
Figure 6:
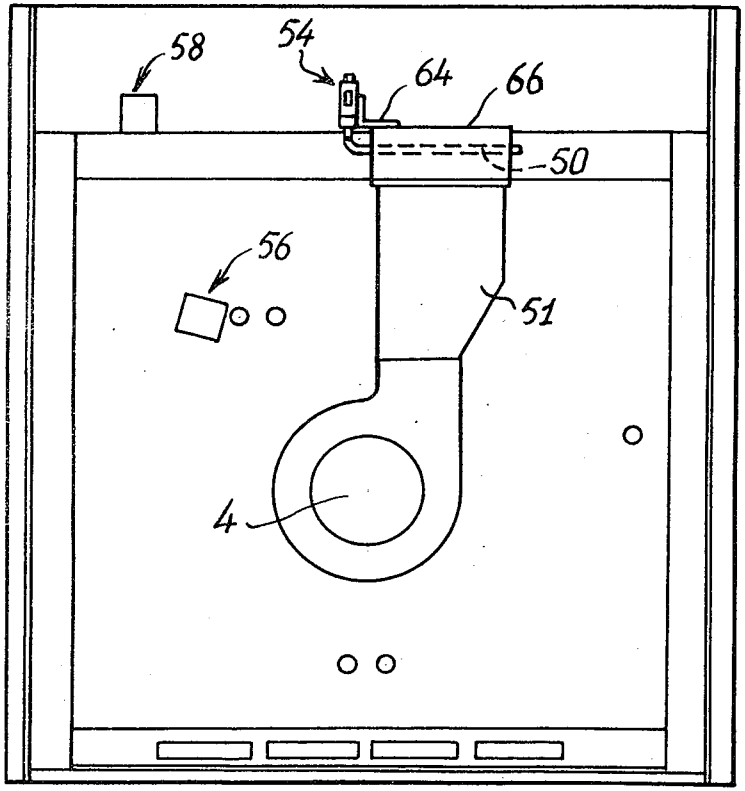
FIG. 6 is an elevational view showing the back wall of the oven of FIG. 5, of which the lining has been removed.
Figure 9:
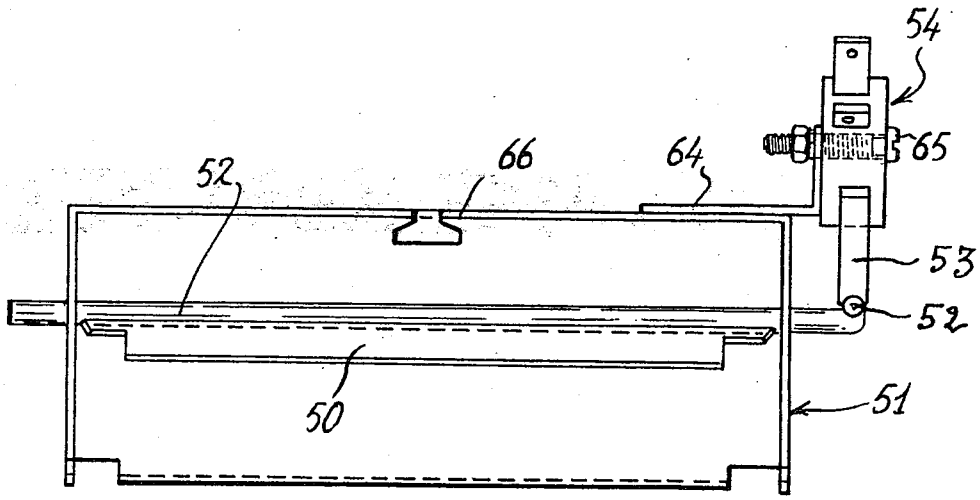
FIG. 9 is an elevational view showing the upper portion of the chimney overlying the turbine and of the safety shutter actuating device.

Regarding the mounting of microswitch 54, it should be noted that the latter is secured to an angle member 64 by means of a screw 65 (FIGS. 7 to 9), this angle member 64 being secured in turn to the upper shunt plate 66 disposed atop the chimney 51.

The above-described electric control circuit operates as follows:

When the user starts the pyrolysis operation, the complete set of thermostats and circuit switches are in the position shown in FIG. 10. The user actuates switches 57, 59 and 63, so that switch 57 engages stud a providing the connection between the turbine 4 and the stud 460° of thermostat 56. After a predetermined time the cooking thermostat 55 set for example at 300° C., is switched to position 330°. When the temperature attains 330° C., the corresponding stage of thermostat 58 is closed and engages stud d. Finally, when the oven temperature attains the critical value of 460° C., thermostat 56 is closed and engages stud 460. This closing of thermostat 56 cuts off the energization of the resistance of grid 23 while restoring the supply of electric current to turbine 4, which is thus started.

The air blown into chimney 51 by turbine 4 causes the safety shutter 50 to pivot to its position 50*a* (FIGS. 8 and 11), so that from the time the shutter 50 is tipped to its operative position 50*a*, the turbine 4 receives electrical energizing current from thermostat 55 both through the safety shutter in position 50*a* and through the closed regulation thermostat 56.

The pyrolysis temperature keeps rising slightly above the critical temperature set at 460° C. and then drops as the grid resistance 23 cools down. When this temperature is below 460° C., thermostat 56 is opened and resumes its position of engagement with stud O, thus energizing again the grid resistance 23. However, when thermostat 56 is subsequently re-opened, turbine 4 remains energized through the safety shutter set in position 50*a*.

When the oven temperature has risen again to the 460-degree mark, thermostat 56 is re-closed by engaging stud 460° and discontinuing the energization of resistance 23. The pyrolytic cleaning cycle will thus keep closing and opening the thermostat 56 successively while turbine 4 remains self-energized by the safety shutter 50 and, under these conditions, the pyrolysis temperature is maintained substantially between about 460° and about 500° C., the time required for completing this pyrolysis being set by programmer 61. Therefore, turbine 4 is somewhat self-ventilated by the second rotor advantageously equipping this turbine which stirs the air in cooling enclosure and improves appreciably the cleaning of the oven door.

When programmer 61 opens, the pyrolysis is stopped, the temperature decreases gradually in the oven, the 330-degree C. stage of thermostat 58 maintaining the ventilation of the assembly by means of turbine 4 until said 330-degree temperature is attained. Above this temperature, the turbine 4 is no more energized and becomes inoperative.

The pyrolysis-controlling electric circuit according to this invention will thus ensure a self-ventilation of turbine 4 throughout the pyrolysis process by virtue of the safety shutter 50, the pyrolysis temperature being regulated at 460° C. by means of thermostat 56.

In addition to the above-mentioned advantageous features of the control circuit of the present invention, another advantage lies in the fact that the air stirring action produced by the turbine 4 beyond 460° C. will safely eliminate smoke as a consequence of the want of overpressure, and also in the adherence to official safety regulations with respect to the carbon monoxide/carbon dioxide ratio.

The fact that turbine 4 operates throughout the time required for performing the pyrolysis assures its self-ventilation and consequently its protection against excessive overheating.

The present invention should not be construed as being strictly limited by the specific forms of embodiment described and illustrated herein, since various modifications and changes may be brought thereto without departing from the basic principles of the invention. Thus, the temperature values, such as 300°, 330° and 460° C., are given by way of example, not of limitation, and likewise the safety shutter 50 may be constructed in any other way equivalent to that described with reference to FIGS. 7 to 9 of the drawings.

What is claimed is:

1. An electric cooking oven for domestic use comprising a cooking enclosure in which an air convection is produced, this air being heated by at least one electrical heating resistance and circulated by a centrifugal turbine mounted in a compartment formed in one of the enclosure walls, said turbine being surrounded by a perforated sleeve contacting said heating resistance so as to be brought to a red-hot condition when said resistance is energized, wherein an electric circuit is provided for controlling the cleaning of said enclosure by pyrolysis, said circuit comprising a pivoting shutter connected to a first control thermostat and to said turbine connected in turn to a second control thermostat so adjusted as to close at a predetermined critical temperature beyond which said turbine must be ventilated to protect same against overheating, said second thermostat being connected, when open, to an electric grill resistance capable of producing the pyrolytic cleaning operation, whereby said turbine will start up automatically when closing said second thermostat at said predetermined critical temperature in order to cause said shutter to pivot to a position in which said pivoting shutter keeps supplying electric power to said turbine while said second thermostat opens after the oven temperature has dropped to a value lower than said predetermined critical temperature.

2. An electric cooking oven for domestic use as claimed in claim 1, wherein said pivoting shutter is mounted in a chimney overlying said compartment formed in one of the enclosure walls, above said turbine, and comprises a blade adapted to pivot from an inoperative position to a position in which electric power is supplied to said turbine, this position being obtained by virtue of the air current blown by said turbine, said blade being provided with resilient means for returning said blade to its inoperative position when said turbine is stopped.

3. An electric cooking oven for domestic use as claimed in claim 2, wherein said shutter is connected to said turbine via a third three-stage thermostat so adjusted as to close at a temperature lower than said predetermined critical temperature necessary for starting up said turbine, said second thermostat being interposed between said first thermostat and said turbine.

4. An electric cooking oven for domestic use as claimed in claim 3, wherein said first thermostat is the cooking thermostat and said second thermostat is capable, when open, to accomplish the pyrolysis until the temperature rises up to the level of said predetermined critical temperature while, during the open period of said second thermostat, said turbine remains energized and self-ventilated through the medium of said shutter and said three-stage thermostat, for example by a temperature stage corresponding to 0° to 330° C. thereof.

* * * * *